US010103491B2

(12) United States Patent
Ju

(10) Patent No.: US 10,103,491 B2
(45) Date of Patent: Oct. 16, 2018

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/709,851

(22) Filed: Sep. 20, 2017

(65) Prior Publication Data

US 2018/0097311 A1 Apr. 5, 2018

Related U.S. Application Data

(60) Provisional application No. 62/404,395, filed on Oct. 5, 2016.

(30) Foreign Application Priority Data

Jan. 11, 2017 (CN) ..... 2017 2 0028481 U

(51) Int. Cl.

| | |
|---|---|
| ***H01R 13/6585*** | (2011.01) |
| ***H01R 13/646*** | (2011.01) |
| ***H01R 13/04*** | (2006.01) |
| ***H01R 13/648*** | (2006.01) |
| ***H01R 13/652*** | (2006.01) |
| ***H01R 13/6581*** | (2011.01) |
| ***H01R 24/60*** | (2011.01) |

(Continued)

(52) U.S. Cl.

CPC ..... *H01R 13/646* (2013.01); *H01R 9/03* (2013.01); *H01R 13/04* (2013.01); *H01R 13/20* (2013.01); *H01R 13/405* (2013.01); *H01R 13/631* (2013.01); *H01R 13/6485* (2013.01); *H01R 13/652* (2013.01); *H01R 13/6581* (2013.01); *H01R 13/6591* (2013.01); *H01R 13/6594* (2013.01); *H01R 13/6597* (2013.01); *H01R 24/60* (2013.01); *H01R 43/0256* (2013.01)

(58) Field of Classification Search

CPC ..... H01R 13/6585; H01R 13/6581; H01R 13/6594; H01R 23/6873; H01R 23/7073; H01R 13/65802

USPC ..... 439/607.36, 607.35, 607.4

See application file for complete search history.

(56) References Cited

U.S. PATENT DOCUMENTS 6,080,016 A * 6/2000 Ho ..... H01R 23/6873 439/108

7,018,238 B1 * 3/2006 Zhi-xuan ..... H01R 13/6582 439/607.36

(Continued)

FOREIGN PATENT DOCUMENTS

CN 204696369 U 10/2015

CN 205282695 U 6/2016

*Primary Examiner* — Gary Paumen

(74) *Attorney, Agent, or Firm* — Locke Lord LLP; Tim Tingkang Xia, Esq.

(57) ABSTRACT

An electrical connector includes an insulating body, multiple terminals disposed at the insulating body, a shielding shell, disposed on a periphery of the insulating body, and a circuit board located at the rear end of the insulating body. The terminals have at least one grounding terminal. The grounding terminal has a first grounding pin extending backward out of the insulating body. The circuit board has a first solder pad and a second solder pad. The first solder pad is connected to the second solder pad. The first grounding pin is conductively connected to the first solder pad, and the shielding shell is electrically connected to the second solder pad.

20 Claims, 8 Drawing Sheets

(51) Int. Cl.

| | |
|---|---|
| ***H01R 13/20*** | (2006.01) |
| ***H01R 13/6591*** | (2011.01) |
| ***H01R 9/03*** | (2006.01) |
| ***H01R 13/405*** | (2006.01) |
| ***H01R 13/631*** | (2006.01) |
| ***H01R 13/6594*** | (2011.01) |
| ***H01R 13/6597*** | (2011.01) |
| ***H01R 43/02*** | (2006.01) |

(56) References Cited

U.S. PATENT DOCUMENTS 7,563,136 B1 * 7/2009 Wu ..... H01R 9/032 439/460
8,323,057 B2 * 12/2012 Ho ..... H01R 12/725 439/607.4
8,506,332 B2 * 8/2013 Sommers ..... H01R 12/725 439/607.32
8,636,546 B2 * 1/2014 He ..... H01R 13/6581 439/607.4
8,662,936 B2 * 3/2014 Chung ..... H01R 24/00 439/607.35
8,777,672 B2 * 7/2014 Chung ..... H01R 13/6461 439/607.35
8,926,367 B2 * 1/2015 Hsu ..... H01R 13/658 439/607.35
8,968,031 B2 * 3/2015 Simmel ..... H01R 13/659 439/108
2005/0032428 A1 * 2/2005 Huang ..... H01R 23/662 439/607.36
2005/0095913 A1 * 5/2005 Fan ..... H01R 13/658 439/607.35
2007/0105440 A1 * 5/2007 Delaney ..... H01R 12/714 439/607.36
2013/0231004 A1 * 9/2013 Yang ..... H01R 12/57 439/607.36
2015/0255905 A1 * 9/2015 Little ..... H01R 13/6658 439/78

* cited by examiner

ELECTRICAL CONNECTOR

CROSS-REFERENCE TO RELATED APPLICATION

This application claims priority and the benefit of U.S. Provisional Application No. 62/404,395, filed on Oct. 5, 2016, the entire contents of which are hereby incorporated by reference.

FIELD OF THE INVENTION

The present invention relates to an electrical connector, and more particularly to an electrical connector having a shielding shell.

BACKGROUND OF THE INVENTION

A known electrical connector includes an insulating body, multiple terminals accommodated in the insulating body, a circuit board connected to the terminals and a shielding shell covering the insulating body and the circuit board. The front surface of the insulating body recesses inwardly to form a mating slot, and the multiple terminals are arranged in two rows at upper and lower sides of the mating slot. The electrical connector further includes a latch member located between the two rows of the terminals. The latch member has a main body portion located between the two rows of the terminals. A latch arm extends forward from each of two sides of the main body portion. Each of the latch arms has a latch portion protruding into the mating slot. Two outermost terminals in each row of the terminals are grounding terminals. Each of the grounding terminals has a contacting portion protruding into the mating slot and a soldering portion exposed from the rear end of the insulating body. Each of the grounding terminals has a "U"-shaped bending structure between the contacting portion and the soldering portion, so that the "U"-shaped bending structure can be in contact with the main body portion of the latch member to form an electrical connection, or one of the grounding terminal and the main body portion forms into a grounding sheet to be in contact with the other. The two latch arms are located at left and right outer sides of the two rows of the terminals, and the latch arms are in contact with the shielding shell to form an electrical connection, so that the grounding terminal and the shielding shell are electrically connected.

In order to make the shielding shell and the grounding terminal electrically connected, compared with other terminals, an additional process step of forming a "U"-shaped bending structure or a grounding sheet is carried out on the grounding terminal, so as to achieve the grounding of the grounding terminal and the latch member, and then the latch member is in contact with the shielding shell to form an electrical connection between the grounding terminal and the shielding shell. The structure of the foregoing electrical connector is complex, and the manufacturing cost is relatively high.

Therefore, a heretofore unaddressed need exists in the art to address the aforementioned deficiencies and inadequacies.

SUMMARY OF THE INVENTION

In one aspect, the present invention relates to an electrical connector with a grounding terminal and a shielding shell being electrically connected and with a simple structure.

In certain embodiments, an electrical connector includes an insulating body, multiple terminals disposed at the insulating body, a shielding shell, disposed on a periphery of the insulating body, and a circuit board, located at the rear end of the insulating body. The multiple terminals have at least one grounding terminal, and the grounding terminal has a first grounding pin extending backward out of the insulating body. The circuit board has a first solder pad and a second solder pad, and the first solder pad is connected to the second solder pad. The first grounding pin is conductively connected to the first solder pad, and the shielding shell is electrically connected to the second solder pad.

In certain embodiments, the circuit board has a notch, the first solder pad is located at one side of the notch in a left-right direction, and the second solder pad is located at the rear of the notch in a front-rear direction.

In certain embodiments, the insulating body has at least one extension block extending backward, the extension block has a guiding slot, the second solder pad is located at the rear of the extension block, the circuit board has a retaining portion located between the second solder pad and the notch, and the retaining portion is retained in the guiding slot.

In certain embodiments, the shielding shell and the second solder pad are electrically connected by soldering via a solder.

In certain embodiments, the electrical connector further includes a middle grounding member, the multiple terminals are arranged in two rows, the middle grounding member is located between the two rows of the terminals, the middle grounding member has at least one second grounding pin extending out of the insulating body, the circuit board has at least one third solder pad, and the second grounding pin is conductively connected to the third solder pad.

In certain embodiments, the third solder pad is connected to the first solder pad.

In certain embodiments, the third solder pad is connected to the second solder pad.

In certain embodiments, a mating slot formed by being recessed inwardly is provided at the front end of the insulating body, the multiple terminals are arranged in one row respectively at upper and lower opposite sides of the mating slot, each of the terminals has a contacting portion protruding into the mating slot, the middle grounding member is located between the two rows of the terminals, the middle grounding member has two latch arms located at left and right opposite sides of the mating slot, and each of the latch arms has a latch portion protruding into the mating slot.

In certain embodiments, the multiple terminals are arranged in two rows and each row of the terminals are provided with the two grounding terminals located at the outer side and disposed symmetrically, and the two first solder pads and the two second solder pads are provided respectively on upper and lower surfaces of the circuit board disposed opposite to each other.

In another aspect, the present invention relates to an electrical connector. In certain embodiments, the electrical connector includes an insulating body, multiple terminals disposed at the insulating body and having at least one grounding terminal, a shielding shell disposed on a periphery of the insulating body, and a circuit board located at the rear end of the insulating body. The multiple terminals are connected to the circuit board, and the shielding shell and the grounding terminal are electrically connected on the circuit board.

In certain embodiments, the circuit board has a first solder pad and a second solder pad, the first solder pad is electrically connected to the second solder pad, the first grounding terminal is conductively connected to the first solder pad, and the shielding shell is electrically connected to the second solder pad.

In certain embodiments, the first solder pad and the second solder pad are arranged in two rows in a front-rear direction.

In certain embodiments, the shielding shell and the second solder pad are electrically connected by soldering via a solder.

In certain embodiments, the electrical connector further comprises a solder, wherein the solder is soldered to the second solder pad, and the solder has an arc-shaped contacting surface contacting the shielding shell.

In certain embodiments, the circuit board has a notch, the first solder pad is located at one side of the notch in a left-right direction, and the second solder pad is located at the rear of the notch in a front-rear direction.

In certain embodiments, the insulating body has at least one extension block extending backward, the extension block has a guiding slot, the second solder pad is located at the rear of the extension block, the circuit board has a retaining portion located between the second solder pad and the notch, and the retaining portion is retained in the guiding slot.

In certain embodiments, the electrical connector further includes a middle grounding member provided in the insulating body. The middle grounding member has at least one second grounding pin extending out of the insulating body, the circuit board has at least one third solder pad, and the second grounding pin is conductively connected to the third solder pad.

In certain embodiments, the third solder pad is connected to the first solder pad.

In certain embodiments, the third solder pad is connected to the second solder pad.

In certain embodiments, a mating slot formed by being recessed inwardly is provided at the front end of the insulating body, the multiple terminals are arranged in one row respectively at upper and lower opposite sides of the mating slot, each of the terminals has a contacting portion protruding into the mating slot, the middle grounding member is located between two rows of the terminals, the middle grounding member has two latch arms located at left and right opposite sides of the mating slot, and each of the latch arms has a latch portion protruding into the mating slot.

Compared with the related art, in certain embodiments of the present invention, by arranging, on the circuit board, the first solder pad conductively connected to the grounding terminal, and by arranging, on the circuit board, the second solder pad electrically connected to the shielding shell, the first solder pad and the second solder pad are electrically connected on the circuit board. Thus, compared with the related art, a grounding path can be formed between the grounding terminal and the shielding shell merely by making a simple change to the connection structure between the first solder pad and the second solder pad on the circuit board, without the need for other elements, such as the latch member.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
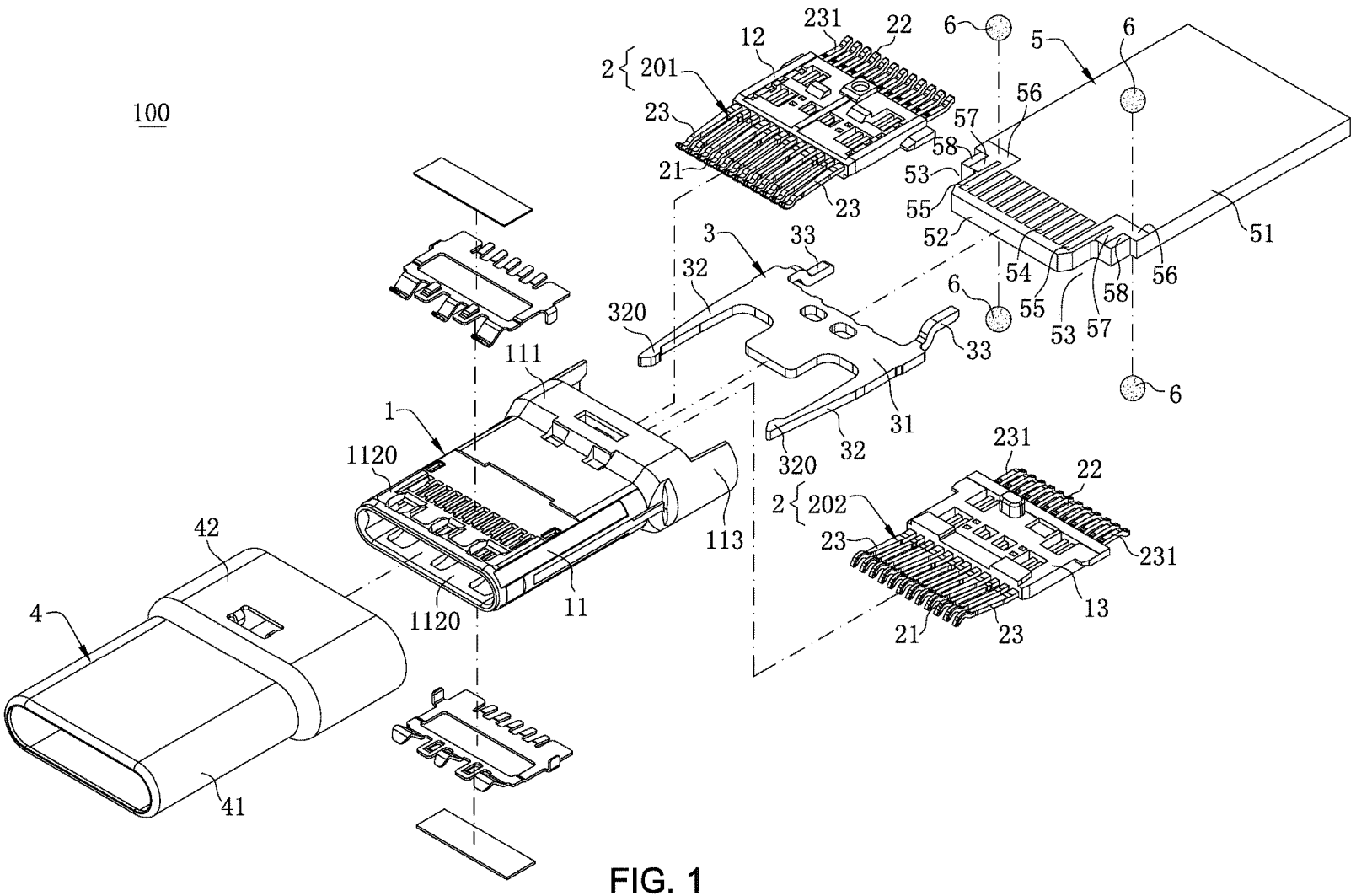
FIG. 1 is a schematic three-dimensional exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

FIG. 1 shows a first embodiment of an electrical connector 100 according to the present invention. In this embodiment, the electrical connector 100 is a universal serial bus (USB) Type-C plug connector 100 which, together with a mating connector, can be inserted in dual orientation. The electrical connector 100 includes an insulating body 1, multiple terminals 2 disposed at the insulating body 1, a middle grounding member 3, a shielding shell 4 disposed on a periphery of the insulating body 1, and a circuit board 5 connected to the multiple terminals 2.

Figure 2:
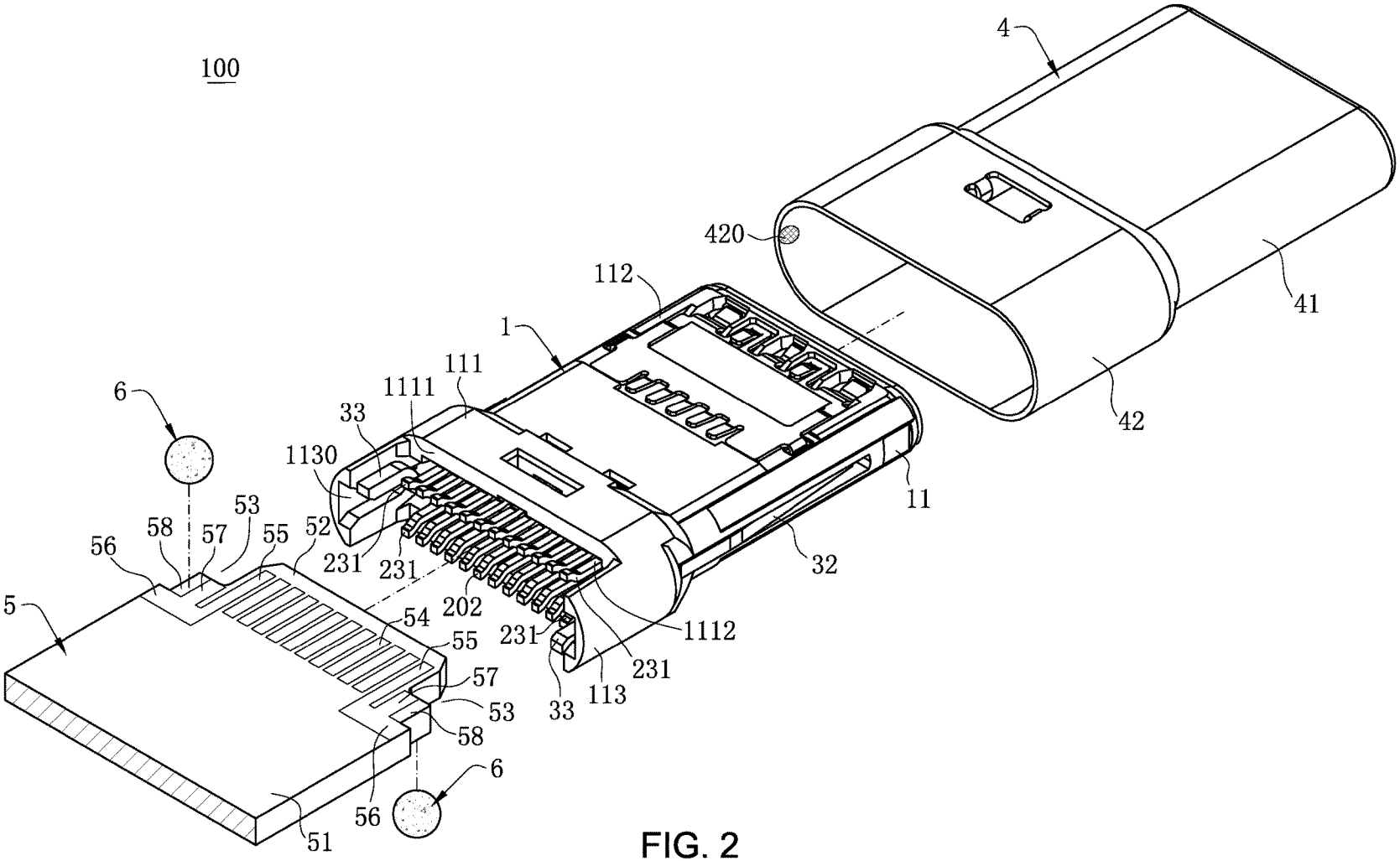
FIG. 2 is a schematic three-dimensional exploded view of terminals and a latch member in FIG. 1 being assembled with the insulating body.
Figure 3:
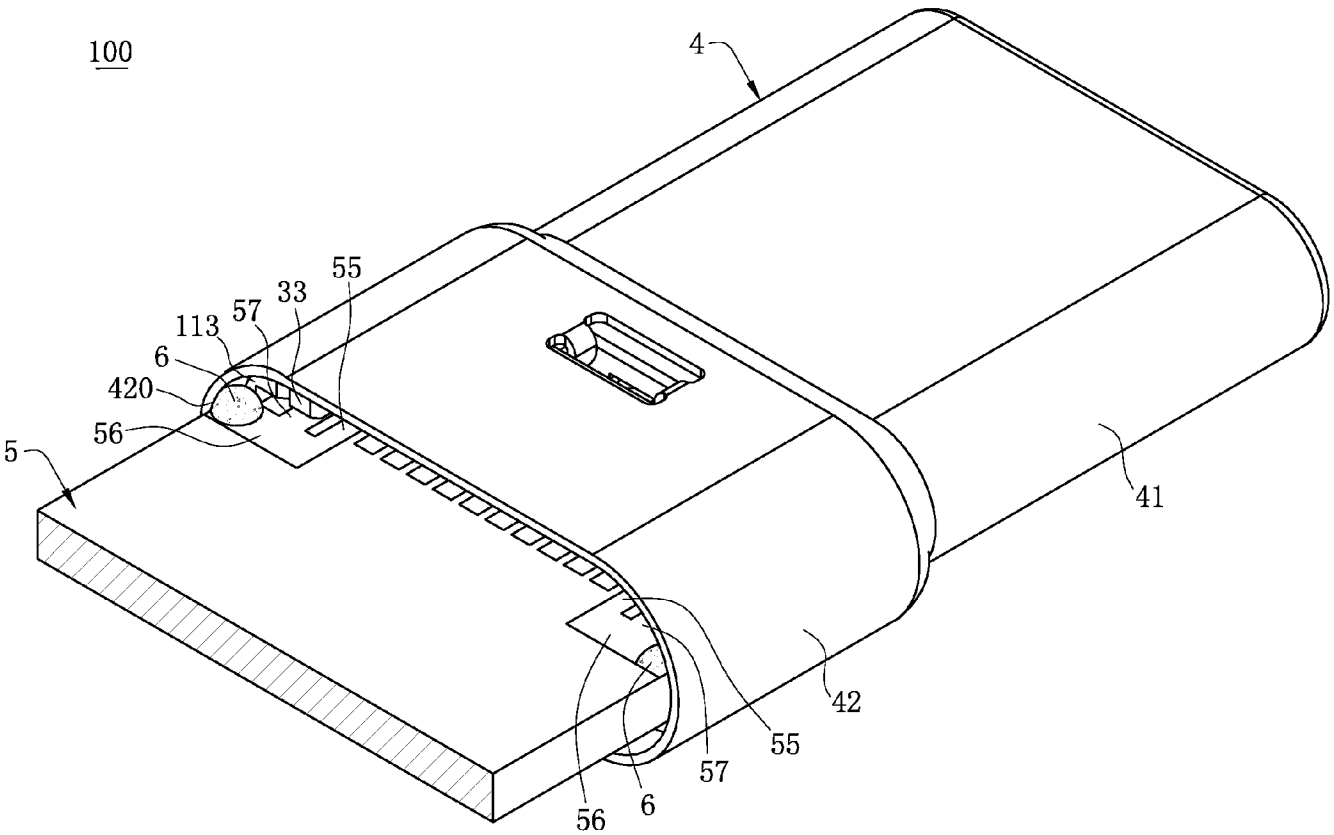
FIG. 3 is a schematic three-dimensional assembled view of FIG. 1.
Figure 4:
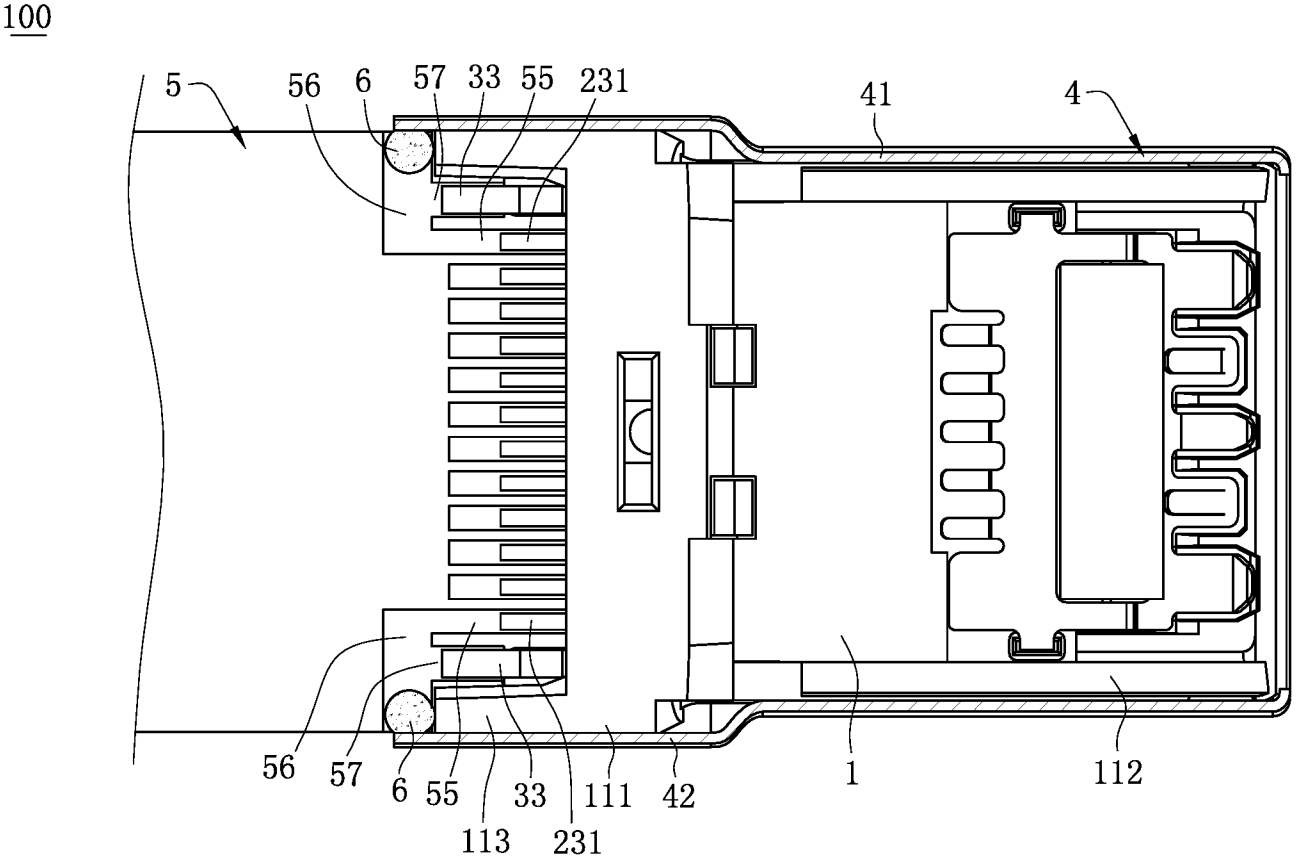
FIG. 4 is a partial sectional view of FIG. 3.

Referring to FIGS. 1 and 2, the insulating body 1 includes an insulating case 11, an upper seat 12 and a lower seat 13. The middle grounding member 3 is mounted between the upper seat 12 and the lower seat 13. The upper seat 12 and the lower seat 13 are snap-fitted with each other and arranged inside the insulating case 11. The insulating case 11 has a base 111 and a tongue 112 formed by extending forward from the base 111. The base 111 has a rear end face 1111, and the base 111 has a mounting space 1112 formed by being recessed forward from the rear end face 1111. The tongue 112 has a mating slot 1120 formed by being recessed backward from the front end face of the tongue 112. The insulating case 11 has an extension block 113 formed by extending backward from left and right sides of the rear end face 1111 respectively. Each of the extension blocks 113 has a guiding slot 1130, the guiding slot 1130 extends in a front-rear direction and communicates with the mounting space 1112 in the front-rear direction. Each of the guiding slots 1130, opposite to each other in the left-right direction, runs inwardly through the extension block 113.

Referring to FIGS. 1 and 2, the multiple terminals 2 include an upper row terminals 201 and a lower row terminals 202 which are vertically arranged. The upper row terminals 201 are insert molded on the upper seat 12, the lower row terminals 202 are insert molded on the lower seat 13, and the transmission specification of the upper row terminals 201 complies with the transmission specification of the lower row terminals 202. That is, the terminals 2 in the upper row terminals 201 and the lower row terminals 202 are defined as grounding, signal, signal, power supply, reserved, signal, signal, reserved, power supply, signal, signal, and grounding. Each of the terminals 2 has a contacting portion 21 exposed forward from the upper seat 12/the lower seat 13 and a soldering portion 22 exposed backward from the upper seat 12/the lower seat 13. The contacting portion 21 protrudes into the mating slot 1120, and the soldering portion 22 exposes backward out of the rear end face 1111. The multiple soldering portions 22 are correspondingly arranged into upper and lower rows between the two extension blocks 113. Each of the upper row terminals 201 and the lower row terminals 202 is provided with the two grounding terminals 23 located at the outer side and disposed symmetrically, and the soldering portion 22 of the grounding terminal 23 is defined as a first grounding pin 231.

Referring to FIGS. 1 and 2, the middle grounding member 3 is formed by blanking a sheet metal, and is located between the upper row terminals 201 and the lower row terminals 202. The middle grounding member 3 has a main body portion 31. The main body portion 31 is sandwiched between the upper seat 12 and the lower seat 13, and the three are all accommodated in the mounting space 1112. The middle grounding member 3 has two latch arms 32 extending forward from two sides of the main body portion 31. The two latch arms 32 are located at left and right sides of the insulating case 11, and each of the latch arms 32 has a latch portion 320 protruding into the mating slot 1120. The middle grounding member 3 has two second grounding pins 33 formed by extending backward from two sides of the main body portion 31, and the two second grounding pins 33 are vertically arranged in a staggered manner.

Referring to FIGS. 1 and 2, the shielding shell 4 includes a first shell and a second shell. The first shell is disposed on the periphery of the insulating case 11, and the second shell is fixedly connected to the rear end of the first shell. The first shell is formed by deep drawing technique, and the first shell has a front shell 41 and a back shell 42. The front shell 41 encloses the tongue 112, and the back shell 42 encloses the base 111 and the extension block 113. The rear end of the back shell 42 protrudes backward out of the rear end of the extension block 113. Multiple soldering areas 420 are provided on the inner surface of the back shell 42. The soldering areas 420 are mainly distributed at left and right sides of the back shell 42, and the top and the bottom of each side are each provided with one of the soldering areas 420.

Referring to FIGS. 1-4, the circuit board 5 has a rear section 51 and a front section 52 formed by protruding forward from the rear section 51. The circuit board 5 is further provided with a notch 53 at left and right sides of the front section 52 respectively, so that the circuit board 5 is substantially of a "convex" shape. Upper and lower surfaces of the front section 52 are each provided with multiple contacts 54 side by side, and the front section 52 is inserted between the two rows of the soldering portions 22, so that the two rows of the soldering portions 22 are correspondingly soldered corresponding to the multiple contacts 54 on the upper and lower surfaces of the circuit board 5. The contact 54 soldered to the first grounding pin 231 is defined as a first solder pad 55, and therefore, the multiple contacts 54 on the upper/lower surfaces of the circuit board 5 have two first solder pads 55 located at the outer side. Upper and lower surfaces of the rear section 51 each have a second solder pad 56 and a third solder pad 57 which are located at the rear of each of the notches 53, and the third solder pad 57 is located between the notch 53 and the second solder pad 56, so that when the circuit board 5 is inserted into the space between the two rows of the terminals 2, the second grounding pin 33 can be always conductively connected to the third solder pad 57. In this embodiment, both the first solder pad 55 and the third solder pad 57 are connected to the second solder pad 56. The first solder pad 55 and the third solder pad 57 extend in the front-rear direction, the second solder pad 56 extends in the left-right direction, and the second solder pad 56 is arranged adjacent to the side edge of the circuit board 5. That is, the first solder pad 55, the second solder pad 56 and the third solder pad 57 form into a big solder pad with a substantially inverted "F" shape. When the circuit board 5 is connected to the multiple terminals 2, the second solder pad 56 is located at the rear of the extension block 113 at the corresponding side, and the second solder pad 56 corresponds to the soldering area 420 at the corresponding side. The electrical connector 100 is further provided with multiple solders 6. One of the solders 6 is provided at each of the second solder pads 56 and the soldering area 420 corresponding to the second solder pad 56 respectively, and the solder 6 can be a solder ball or solder paste. The soldering area 420 is subjected to process treatment so as to be easily connected to the solder 6. The solder 6 is melted by heating and is then connected to the second solder pad 56 and the soldering area 420, so that a grounding path is formed between some of the grounding terminals 23, the shielding shell 4 and the middle grounding member 3, or a grounding path is formed between some of the grounding terminals 23 and the shielding shell 4. The two second grounding pins 33 are soldered to the third solder pads 57 at the corresponding sides on the upper and lower surfaces of the circuit board 5. The rear section 51 has a retaining portion 58 located between each of the notches 53 and the second solder pad 56 at the corresponding side thereof. Each retaining portion 58 is located, in the left-right direction, at the outer side of the third solder pad 57 at the corresponding side. Each retaining portion 58 is retained in the guiding slot 1130, to guide the circuit board 5 during its insertion and to achieve final fixation, so as to prevent the disengagement of the circuit board 5 from the insulating body 1 in the front-rear direction, and to prevent the circuit board 5 from swaying in the left-right direction.

Figure 5:
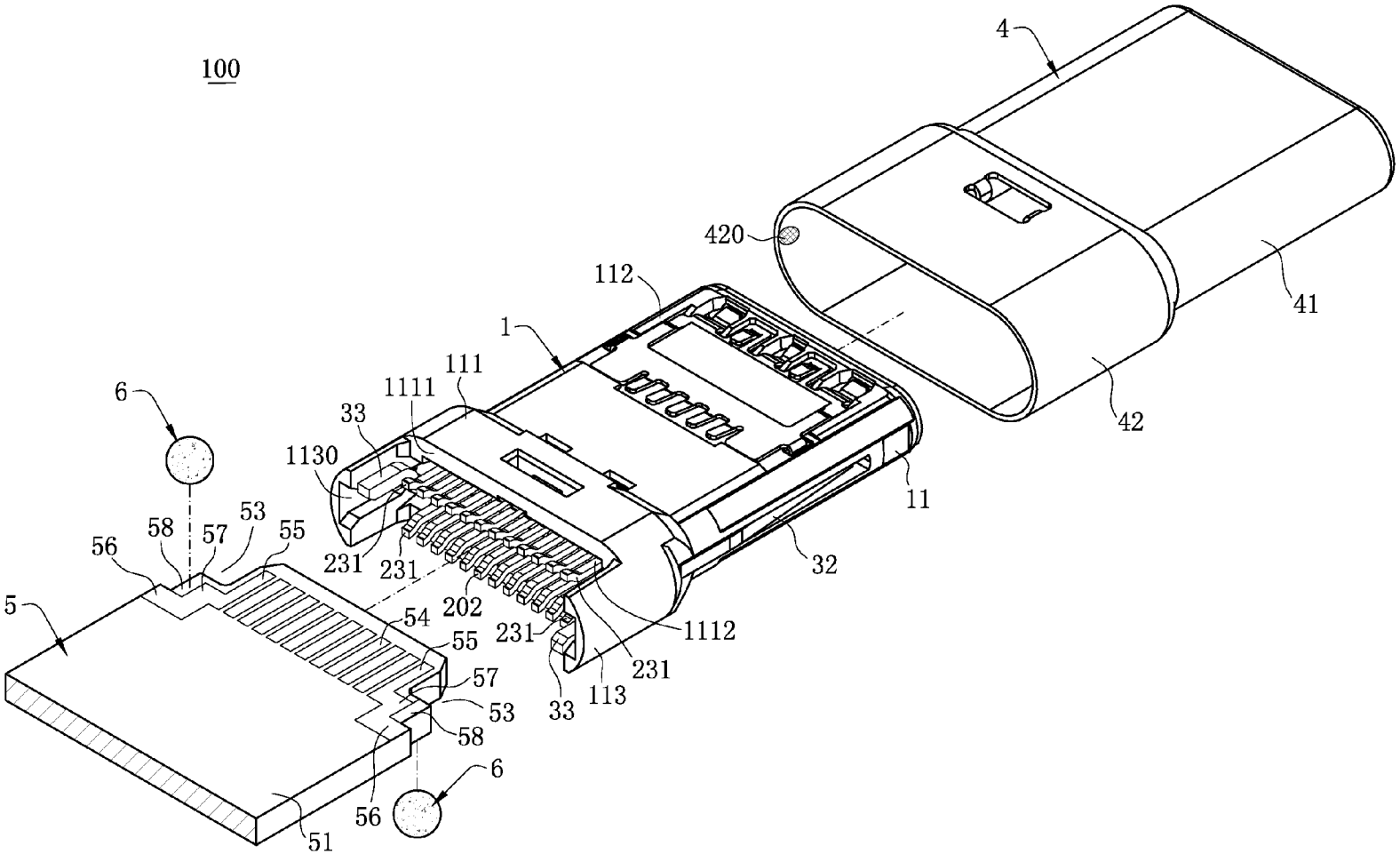
FIG. 5 is a schematic three-dimensional exploded view of an electrical connector according to a second embodiment of the present invention.

FIG. 5 shows a second embodiment of an electrical connector 100 according to the present invention. In this embodiment, most structures are the same as those in the first embodiment, and details are not described herein again. This embodiment differs from the first embodiment in that the first solder pad 55 is not connected to the second solder pad 56, but the first solder pad 55 is connected to the third solder pad 57, and the third solder pad 57 is connected to the second solder pad 56.

Figure 6:
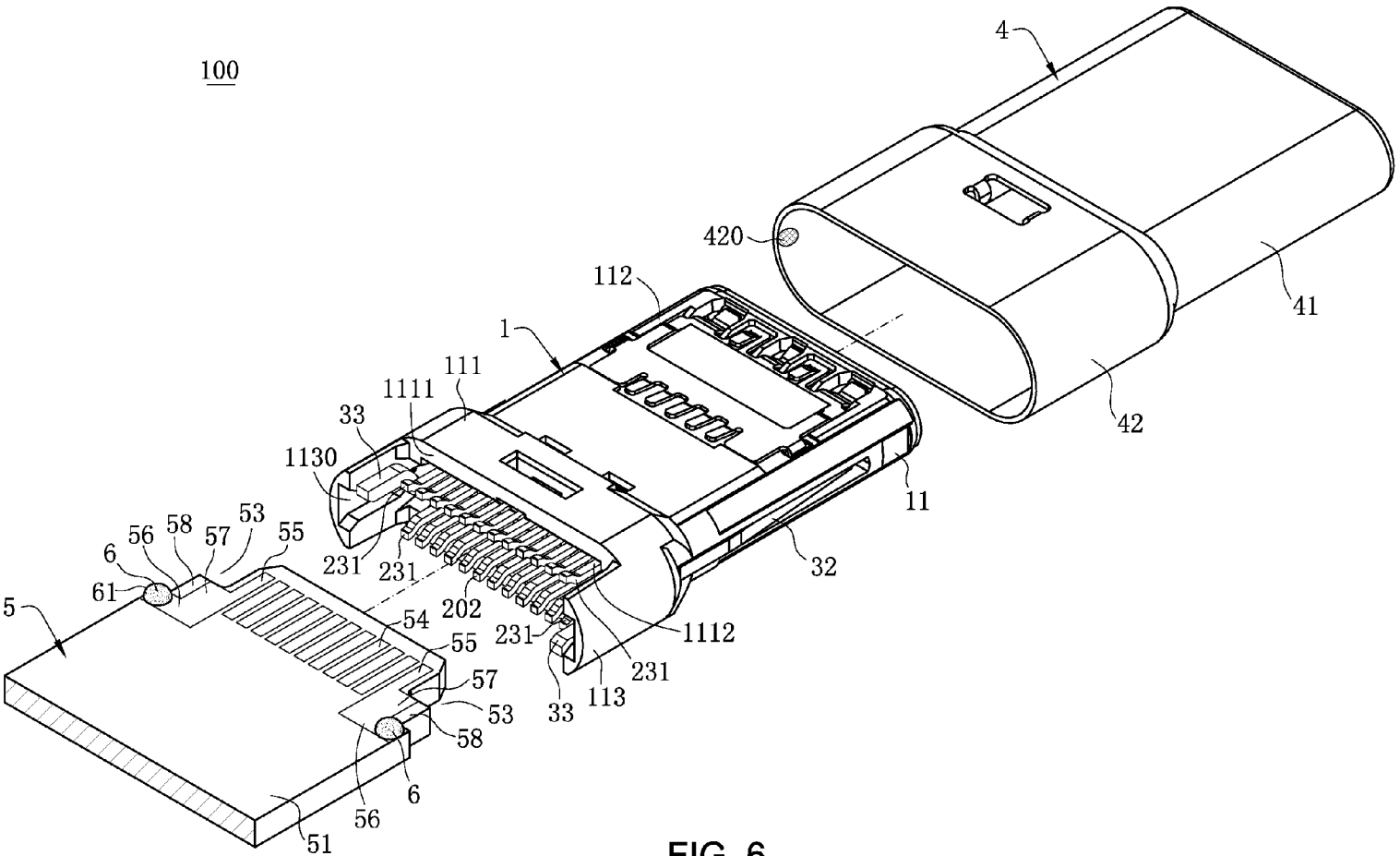
FIG. 6 is a schematic three-dimensional exploded view of an electrical connector according to a third embodiment of the present invention.

FIG. 6 shows a third embodiment of an electrical connector 100 according to the present invention. In this embodiment, most structures are the same as those in the first embodiment, and details are not described herein again. This embodiment differs from the first embodiment in that the solder 6 is firstly soldered to the second solder pad 56, and the solder 6 has an arc-shaped contacting surface 61 which is in contact with the shielding shell 4 to form an electrical connection. The first solder pad 55, the second solder pad 56 and the third solder pad 57 can be connected to one another in pairs, and can also be electrically connected in pairs by a conductive path (not shown) on the circuit board 5.

Figure 7:
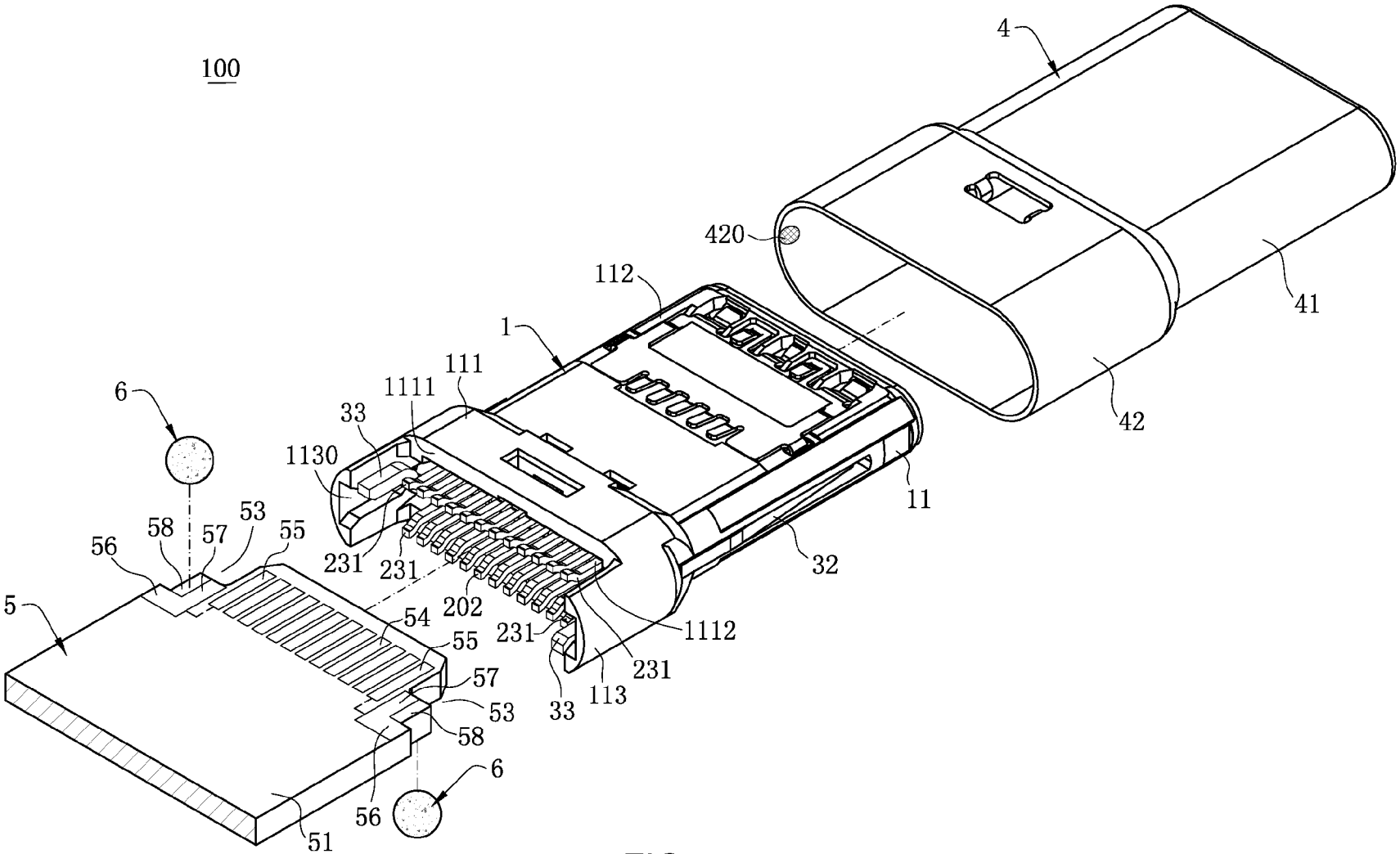
FIG. 7 is a schematic three-dimensional exploded view of an electrical connector according to a fourth embodiment of the present invention.

FIG. 7 shows a fourth embodiment of an electrical connector 100 according to the present invention. In this embodiment, most structures are the same as those in the first embodiment, and details are not described herein again. This embodiment differs from the first embodiment in that the first solder pad 55 and the second solder pad 56 are electrically connected by a conductive path on the circuit board 5, and the second solder pad 56 is directly connected to the third solder pad 57.

Figure 8:
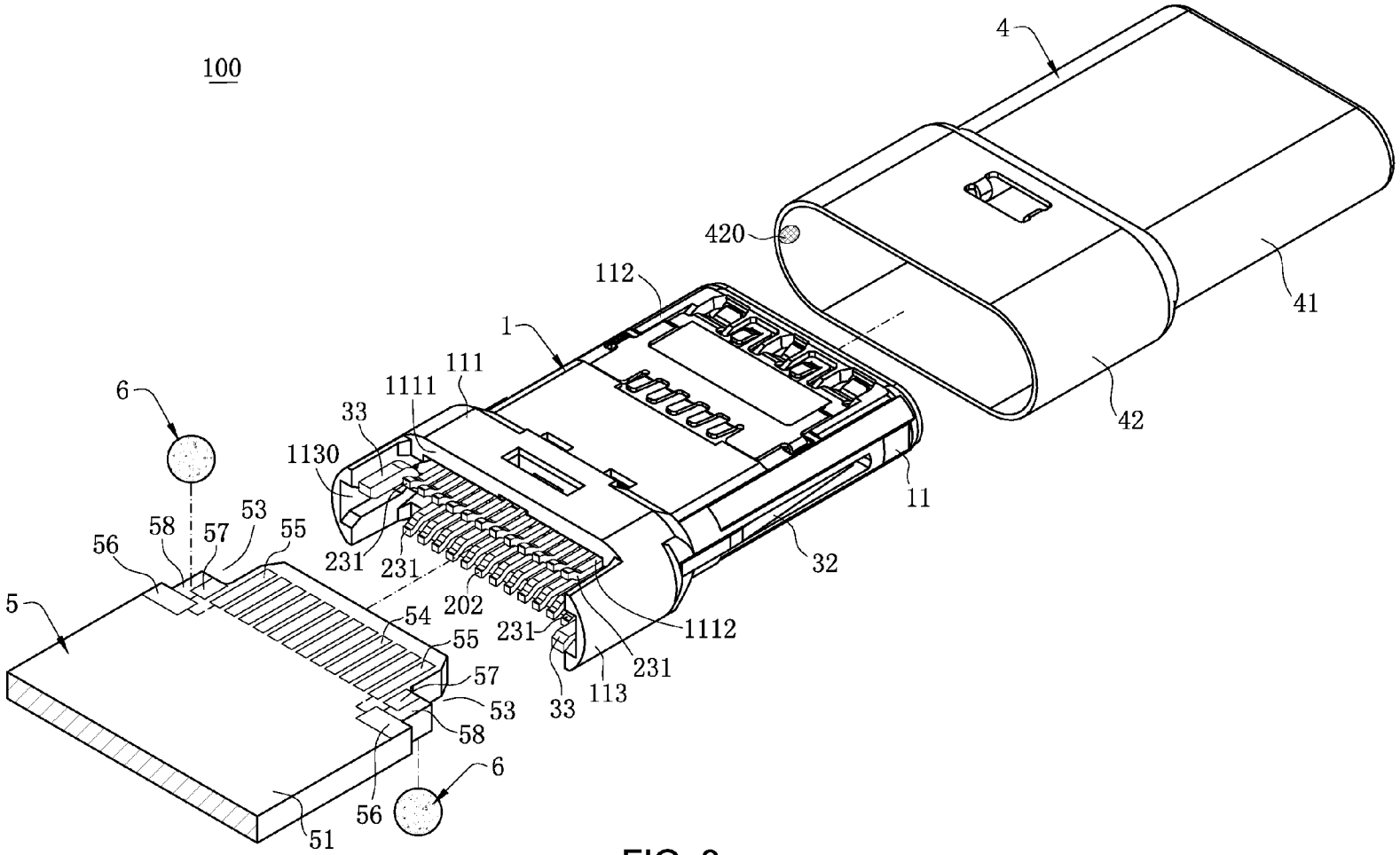
FIG. 8 is a schematic three-dimensional exploded view of an electrical connector according to a fifth embodiment of the present invention.

FIG. 8 shows a fifth embodiment of an electrical connector 100 according to the present invention. In this embodiment, most structures are the same as those in the first embodiment, and details are not described herein again. This embodiment differs from the first embodiment in that the first solder pad 55 and the second solder pad 56 are electrically connected by a conductive path on the circuit board 5, and the second solder pad 56 and the third solder pad 57 are electrically connected by a conductive path on the circuit board 5.

In summary, the electrical connector according to certain embodiments of the present invention has the following beneficial advantages:

1. By arranging, on the circuit board 5, the first solder pad 55 conductively connected to the grounding terminal 23 and the second solder pad 56 electrically connected to the shielding shell 4, and electrically connecting the first solder pad 55 and the second solder pad 56 on the circuit board 5, a grounding path can be formed between the grounding terminal 23 and the shielding shell 4 merely by making a simple change to the connection structure between the first solder pad 55 and the second solder pad 56 on the circuit board 5, without the need for other elements, such as the latch member 3.

2. Both the first solder pad 55 and the third solder pad 57 are connected to the second solder pad 56, or the first solder pad 55 is connected to the third solder pad 57, and the second solder pad 56 is connected to the third solder pad 57. Thus, there is no need to arrange conductive paths on the circuit board 5, which simplifies the design of the circuit board 5, reduces the number of conductive paths on the circuit board 5, and facilitate the arrangement of conductive paths electrically connected to the other terminals 2.

3. The front shell is formed by deep drawing technique, and the soldering area 420 is connected together with the second solder pad 56 via the solder 6. Thus, there is no need to form other structures on the front shell to be conductively connected to the second solder pad 56, and the front shell and the second solder pad 56 can be soldered together merely by melting the solder 6.

4. The retaining portion 58 is located, in the left-right direction, at the outer side of the third solder pad 57 at the corresponding side, and the retaining portion 58 is retained in the guiding slot 1130, to guide the circuit board 5 during its insertion and to achieve final fixation, so as to prevent the disengagement of the circuit board 5 from the insulating body 1 in the front-rear direction, and to prevent the circuit board 5 from swaying in the left-right direction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body;

a plurality of terminals disposed at the insulating body, wherein the terminals includes at least one grounding terminal, and the at least one grounding terminal has a first grounding pin extending backward out of the insulating body;

a shielding shell disposed on a periphery of the insulating body; and a circuit board located at a rear end of the insulating body, wherein the circuit board comprises a first solder pad and a second solder pad, the first solder pad and the second solder pad are arranged in two rows in a front-rear direction, the first solder pad is connected to the second solder pad, the first grounding pin is conductively connected to the first solder pad, and the shielding shell is electrically connected to the second solder pad.

2. The electrical connector according to claim 1, wherein the circuit board comprises a notch, the first solder pad is located at one side of the notch in a left-right direction, and the second solder pad is located at a rear of the notch in the front-rear direction.

3. The electrical connector according to claim 2, wherein:

the insulating body comprises at least one extension block extending backward, wherein the extension block has a guiding slot, and the second solder pad is located at a rear of the extension block; and the circuit board has a retaining portion located between the second solder pad and the notch, the retaining portion being retained in the guiding slot.

4. The electrical connector according to claim 1, wherein the shielding shell and the second solder pad are electrically connected by soldering via a solder.

5. The electrical connector according to claim 1, further comprising a middle grounding member, wherein the terminals are arranged in two rows, the middle grounding member is located between the two rows of the terminals, the middle grounding member has at least one second grounding pin extending out of the insulating body, the circuit board has at least one third solder pad, and the second grounding pin is conductively connected to the third solder pad.

6. The electrical connector according to claim 5, wherein the third solder pad is connected to the first solder pad.

7. The electrical connector according to claim 5, wherein the third solder pad is connected to the second solder pad.

8. The electrical connector according to claim 5, wherein a mating slot is formed by recessing inward from a front end of the insulating body, the terminals are arranged in one row respectively at upper and lower opposite sides of the mating slot, each of the terminals has a contacting portion protruding into the mating slot, the middle grounding member is located between the two rows of the terminals, the middle grounding member has two latch arms located at left and right opposite sides of the mating slot, and each of the latch arms has a latch portion protruding into the mating slot.

9. The electrical connector according to claim 1, wherein the terminals are arranged in two rows and each row of the terminals are provided with two grounding terminals located at outer sides and disposed symmetrically, and the two first solder pads and the two second solder pads are provided respectively on upper and lower surfaces of the circuit board disposed opposite to each other.

10. An electrical connector, comprising:

an insulating body;

a plurality of terminals disposed at the insulating body and having at least one grounding terminal;

a shielding shell disposed on a periphery of the insulating body;

a middle grounding member provided in the insulating body, wherein the middle grounding member has at least one grounding pin extending out of the insulating body; and a circuit board located at a rear end of the insulating body, wherein the circuit board comprises a first solder pad, a second solder pad and at least one third solder pad, the first solder pad is electrically connected to the second solder pad, the at least one grounding terminal is conductively connected to the first solder pad, the shielding shell is electrically connected to the second solder pad, and the at least one grounding pin is conductively connected to the third solder pad, wherein the terminals are connected to the circuit board, and the shielding shell and the at least one grounding terminal are electrically connected on the circuit board.

11. The electrical connector according to claim 10, wherein the first solder pad and the second solder pad are arranged in two rows in a front-rear direction.

12. The electrical connector according to claim 10, wherein the shielding shell and the second solder pad are electrically connected by soldering via a solder.

13. The electrical connector according to claim 10, further comprising a solder, wherein the solder is soldered to the second solder pad, and the solder has an arc-shaped contacting surface contacting the shielding shell.

14. The electrical connector according to claim 10, wherein the circuit board comprises a notch, the first solder pad is located at one side of the notch in a left-right direction, and the second solder pad is located at a rear of the notch in a front-rear direction.

15. The electrical connector according to claim 14, wherein:

the insulating body comprises at least one extension block extending backward, wherein the extension block has a guiding slot, the second solder pad is located at a rear of the extension block; and the circuit board has a retaining portion located between the second solder pad and the notch, and the retaining portion being retained in the guiding slot.

16. The electrical connector according to claim 10, wherein the third solder pad is connected to the first solder pad.

17. The electrical connector according to claim 10, wherein the third solder pad is connected to the second solder pad.

18. The electrical connector according to claim 10, wherein a mating slot formed by recessing inward from a front end of the insulating body, the terminals are arranged in one row respectively at upper and lower opposite sides of the mating slot, each of the terminals has a contacting portion protruding into the mating slot, the middle grounding member is located between two rows of the terminals, the middle grounding member has two latch arms located at left and right opposite sides of the mating slot, and each of the latch arms has a latch portion protruding into the mating slot.

19. The electrical connector according to claim 10, wherein the first solder pad is connected to the second solder pad on a surface of the circuit board.

20. An electrical connector, comprising:

an insulating body;

a plurality of terminals disposed at the insulating body, wherein the terminals includes at least one grounding terminal, and the at least one grounding terminal has a first grounding pin extending backward out of the insulating body;

a shielding shell disposed on a periphery of the insulating body; and a circuit board located at a rear end of the insulating body, wherein the circuit board comprises a first solder pad and a second solder pad, the first solder pad and the second solder pad are electrically connected on the circuit board, the first grounding pin is conductively connected to the first solder pad, and the shielding shell is electrically connected to the second solder pad;

wherein the circuit board further comprises a notch, the first solder pad is located at one side of the notch in a left-right direction, and the second solder pad is located at a rear of the notch in a front-rear direction.

* * * * *